US005975150A

United States Patent [19]

Barlasov et al.

[11] Patent Number: 5,975,150

[45] Date of Patent: Nov. 2, 1999

[54] STRAPPING BAND TIGHTENING DEVICE

[75] Inventors: Pavlo Barlasov, San Jose, Calif.; Roland Henry, Camp Hill, Pa.; Leonid Perelman, Cupertino, Calif.

[73] Assignee: Teknika USA, Inc., San Jose, Calif.

[21] Appl. No.: 09/089,936

[22] Filed: Jun. 3, 1998

[51] Int. Cl.[6] ..... B21F 9/02

[52] U.S. Cl. ..... 140/93.4

[58] Field of Search ..... 140/93.3, 93.4, 140/123.5; 100/30; 242/388.1–388.5

[56] References Cited

U.S. PATENT DOCUMENTS

| | | | |
|---|---|---|---|
| 1,273,115 | 7/1918 | Brooks | 140/93.4 |
| 1,836,147 | 12/1931 | Wright | 140/93.4 |
| 2,349,608 | 5/1944 | Bramble | 140/93.4 X |
| 2,375,769 | 5/1945 | Childress et al. | 140/93.4 |
| 3,189,060 | 6/1965 | Attas | 140/93.4 X |
| 3,211,186 | 10/1965 | Bushman | 140/93.4 |
| 3,232,323 | 2/1966 | Dimmett | 140/93.4 |
| 3,360,017 | 12/1967 | Vilcins | 140/93.4 |
| 3,650,301 | 3/1972 | Karass | 140/93.4 |
| 3,695,307 | 10/1972 | Kuoni | 140/93.4 |
| 3,811,482 | 5/1974 | Back et al. | 140/93.4 |
| 3,837,373 | 9/1974 | Beardsley | 140/93.4 |
| 4,015,643 | 4/1977 | Cheung | 140/93.4 |
| 4,056,128 | 11/1977 | Konrad | 140/93.4 |
| 4,223,704 | 9/1980 | Glaus | 140/93.4 |
| 4,282,907 | 8/1981 | Massion et al. | 140/123.5 X |
| 4,398,572 | 8/1983 | Fromm | 140/93.2 |
| 4,561,475 | 12/1985 | Hinden | 140/123.5 |
| 4,574,848 | 3/1986 | Bartzick et al. | 140/123.5 X |
| 5,181,546 | 1/1993 | Synek | 140/93.4 |

FOREIGN PATENT DOCUMENTS

| | | | |
|---|---|---|---|
| 456185 | 4/1949 | Canada | 140/93.4 |

*Primary Examiner*—David A. Scherbel
*Assistant Examiner*—Anthony Ojini
*Attorney, Agent, or Firm*—The Kline Law Firm

[57] ABSTRACT

A method of and apparatus for applying a tension force to a strapping band, and then securing the band with a seal, in order to secure a plurality of goods together, or to secure a package for shipping. The apparatus allows the user to feed the strapping band through the machine so that both ends of the band are secured in a rotating windlass. The windlass is then rotated to apply an equalized tension force to the band. The tension force is divided by the apparatus pulling both ends of the band simultaneously, the resultant forward force on the apparatus therefore being zero. After each banding operation, a return mechanism automatically positions the windlass in an optimum orientation for inserting the band for a successive banding operation.

11 Claims, 9 Drawing Sheets

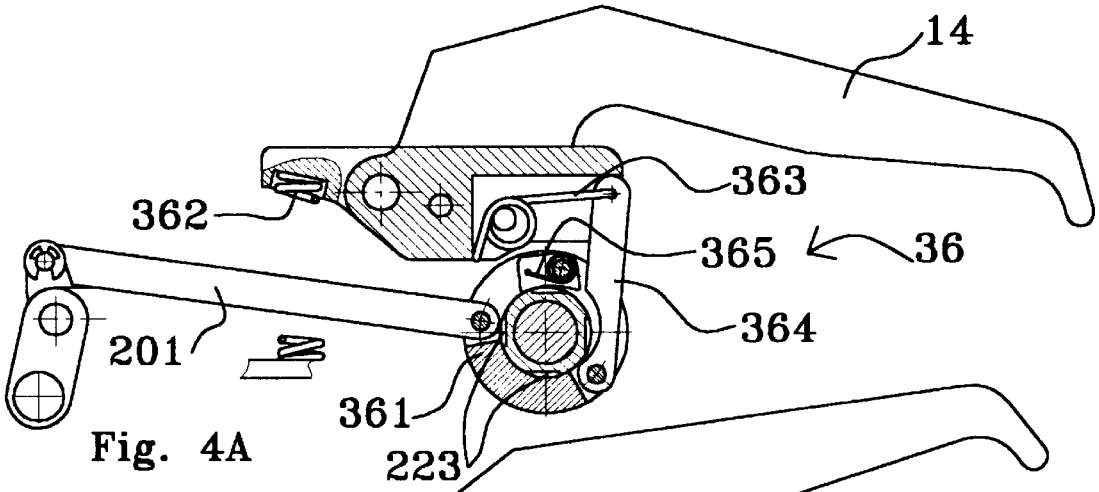
Fig. 4A
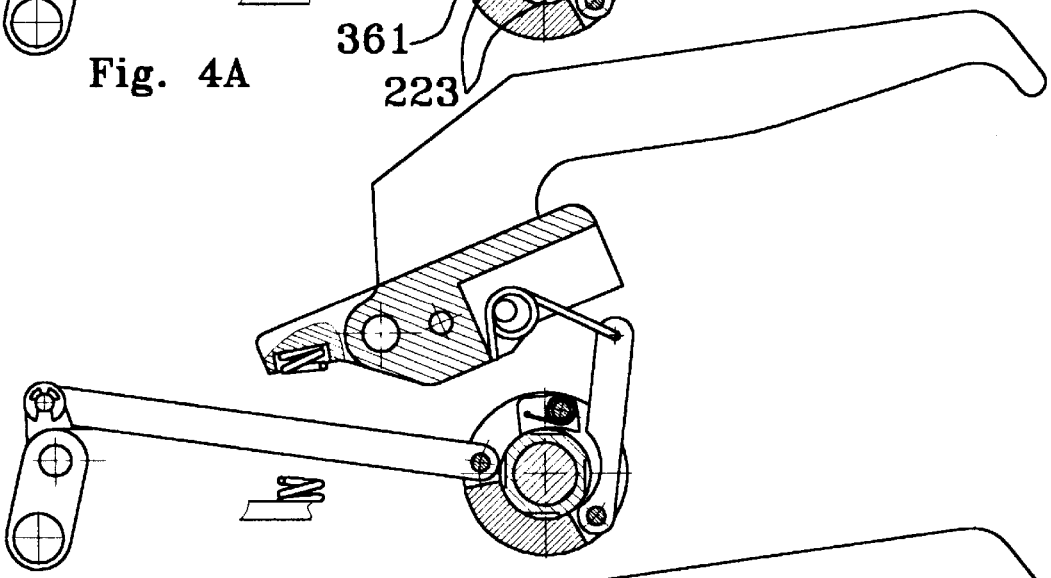
Fig. 4B
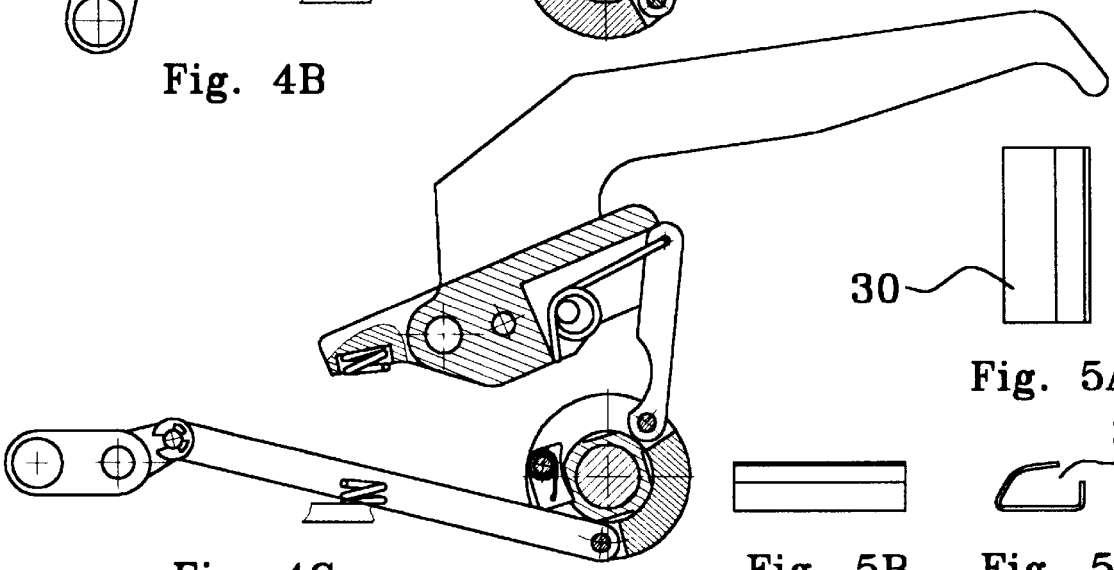
Fig. 4C
Fig. 5A
Fig. 5B
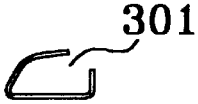
Fig. 5C

STRAPPING BAND TIGHTENING DEVICE

FIELD OF THE INVENTION

The present invention relates generally to the banding together of items into a bundle secured by a tensioned encircling strap, and more particularly is a method of, and apparatus for, banding articles of manufacture with a banding strap. The banding is accomplished while applying tention in two opposing directions, the opposing tensioning forces being equal in magnitude so that there is no tendency of the banding apparatus to move relative to the articles being banded, and so that the pressure of the banding strap is equalized around the package.

BACKGROUND OF THE INVENTION

Binding articles of manufacture together with a metal or plastic band is well known in the prior art. Bundling multiple items together in this manner, or simply strapping a package with a band, is a very common way for manufacturers to secure their products for shipping. The prior art banding devices that are commonly used in industry all operate in essentially the same way: One end of the securing band is passed around the goods to be bundled and then anchored in the banding apparatus by means of a gripping clamp, leaving a free end 4–6" long. The other end of the band is affixed to a tightening means (usually a rotating windlass), in the machine that applies incremental force to the strap so that the strap is tightened around the bundle as the user applies tension. The free end of the strap overlaps the tensioned band at a point where a seal is loaded into the machine. The user operates a ratchet that rotates the windlass until the strap is pulled as tight as the user desires. The seal is then crimped to lock the two ends of the strap together so that the bundle is held securely.

One prior art device that accomplishes the bundling described above is the "Banding Apparatus" of Synak, U.S. Pat. No. 5,181,546, issued Jan. 26, 1993. This device includes expansion screws to prevent the crimping force on the seal from becoming so great that the device is broken or damaged.

Another banding device in the prior art is the "apparatus for Producing a Connection Between Two Overlapping Band Sections of a Package Strip and Improved Closure Seal for Use Therewith" of Konrad, U.S. Pat. No. 4,056,128, issued Nov. 1, 1977. As indicated in the title, this device uses the typical banding process, but claims an improved means of fastening the seal to secure the band after tightening.

One shortcoming of the prior art devices is that due to the means of tightening, that is, securing one point and applying the tension to another point of the band, the banding apparatus tends to be drawn across the bundle being banded. This can make it difficult if not impossible to properly crimp the seal if the banding apparatus is drawn to the edge of the bundle or package.

Another shortcoming of prior art devices is that they apply force to only one side of the band, which results in unequal forces being applied to the package. This can cause one side of the package to be crushed, or the band to be broken, before the desired tension is achieved.

Still another problem with prior art devices is that the jaws of the securing means wear out, allowing the band to slip before the desired tension is achieved. Even with a new securing means, the prior art devices can only apply a tension of approximately 500 pounds before the band slips in the securing means. This tension is not sufficient in some applications. Further, the teeth of the securing means can puncture the band, thereby significantly reducing its breaking strength.

Another problem in prior art devices is that due to space constraints, the cutting blade can come into contact with the band as tension is applied. This can easily damage the band, thereby reducing the effectiveness of the banding operation.

Accordingly, it is an object of the present invention to provide a banding apparatus that tightens the banding strap by distributing the tension force to two points on the strap. This balances the forces acting on the banding apparatus so that the machine does not tend to move during the band tensioning operation, and so that one side of the package is not prematurely crushed. It also balances the force applied to the strap so that the tension of the band is equalized around the package.

It is another object of the present invention to provide a machine that eliminates the need for a gripping clamp to secure the band for tightening.

SUMMARY OF THE INVENTION

The present invention is a method of and apparatus for applying a tension force to a strapping band, and then securing the band with a seal, in order to secure a plurality of goods together, or to secure a package for shipping. The device allows the user to feed the strapping band through the apparatus so that both ends of the band are secured in a windlass. The windlass is then rotated to apply an equalized tension force to the band. The tension force is split by the apparatus pulling both ends of the band simultaneously, the resultant forward force on the machine therefore being zero. After each banding operation, a return mechanism automatically positions the windlass in an optimum orientation for inserting the band for a successive banding operation.

An advantage of the present invention is that force is applied equally to two ends of the strap. The result is that the banding apparatus does not move relative to the package, and that the force on the strapping band is distributed equally around the package.

Another advantage of the present invention is that the need for a toothed gripping clamp to secure the band is eliminated. The toothed jaws of the gripping clamp can damage the strap and are the elements that wear out most quickly in the prior art devices. When the toothed jaws are worn, the user is not able to apply the desired tension to the strap. Therefore elimination of these parts greatly extends the useful life of the machine. Elimination of the griping clamp also allows the use of a smaller base, thereby allowing the apparatus to be used on smaller packages. It also allows sufficient room to install a cutting device in the apparatus that is improved over the prior art.

A further advantage of the present invention is that a return device returns the windlass to an optimal position to load the band prior to every banding operation, thereby reducing the time required for the banding operation.

A still further advantage of the present invention is that insertion of the seal is into a side of the device, which greatly facilitates the loading of the seal relative to the prior art devices.

Yet another advantage of the present invention is the improved crimping mechanism which allows the use of inexpensive standard seals in addition to the specially designed seals required for the prior art devices.

These and other objects and advantages of the present invention will become apparent to those skilled in the art in view of the description of the best presently known mode of carrying out the invention as described herein and as illustrated in the drawings.

BRIEF DESCRIPTION OF THE DRAWINGS

FIGS. 4A–C illustrate the return mechanism of the present invention with the actuation arm lowered, raised with tension on the windlass, and raised with the tension released respectively.

FIGS. 5A–C show the seal used to secure the band.

DETAILED DESCRIPTION OF THE INVENTION

The present invention is a method of securing a band around a package or a plurality of goods to be bound together, and the apparatus to tighten, secure, and cut the band.

Figure 1:
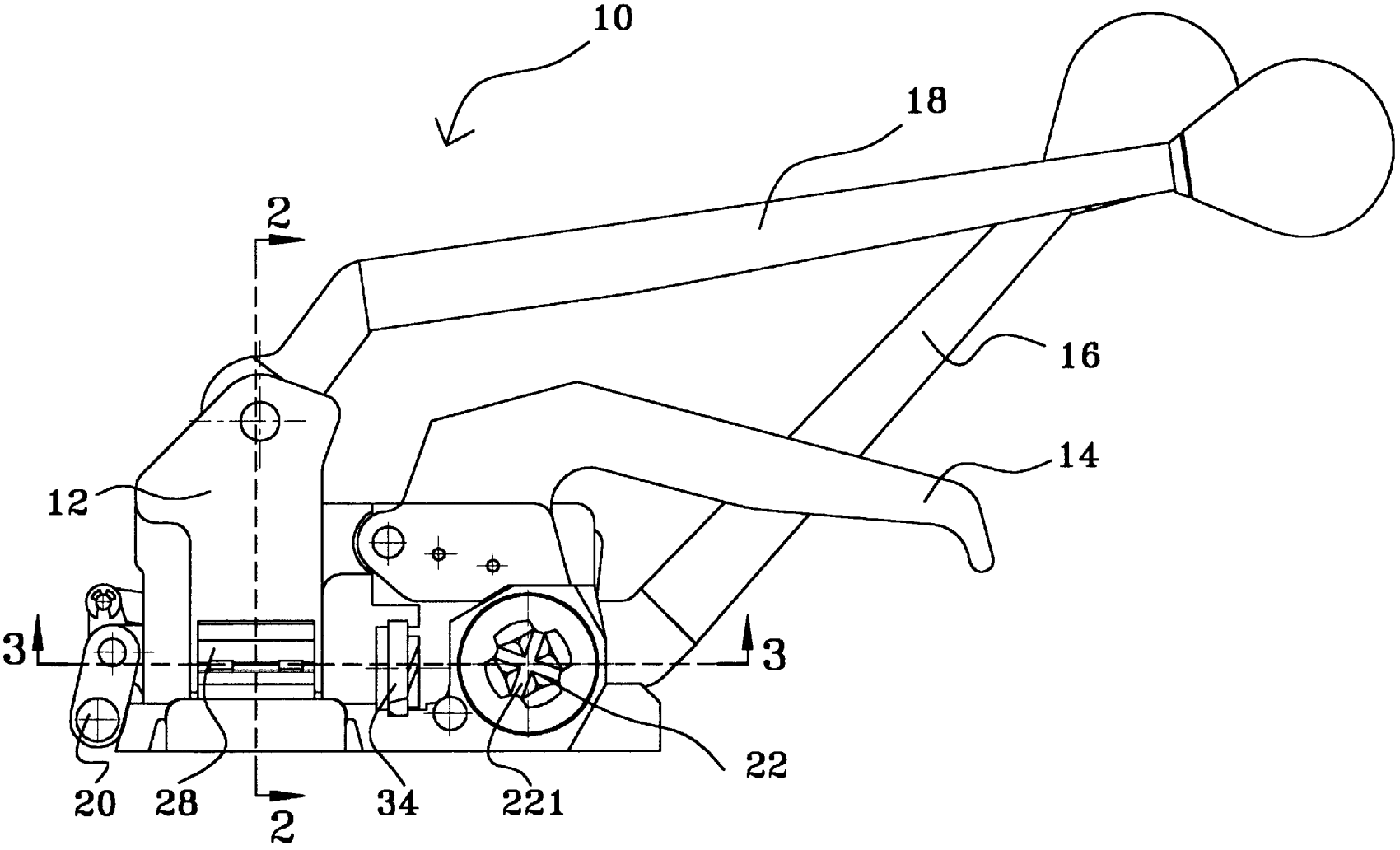
FIG. 1 is a side view of the banding apparatus of the present invention.
Figure 2:
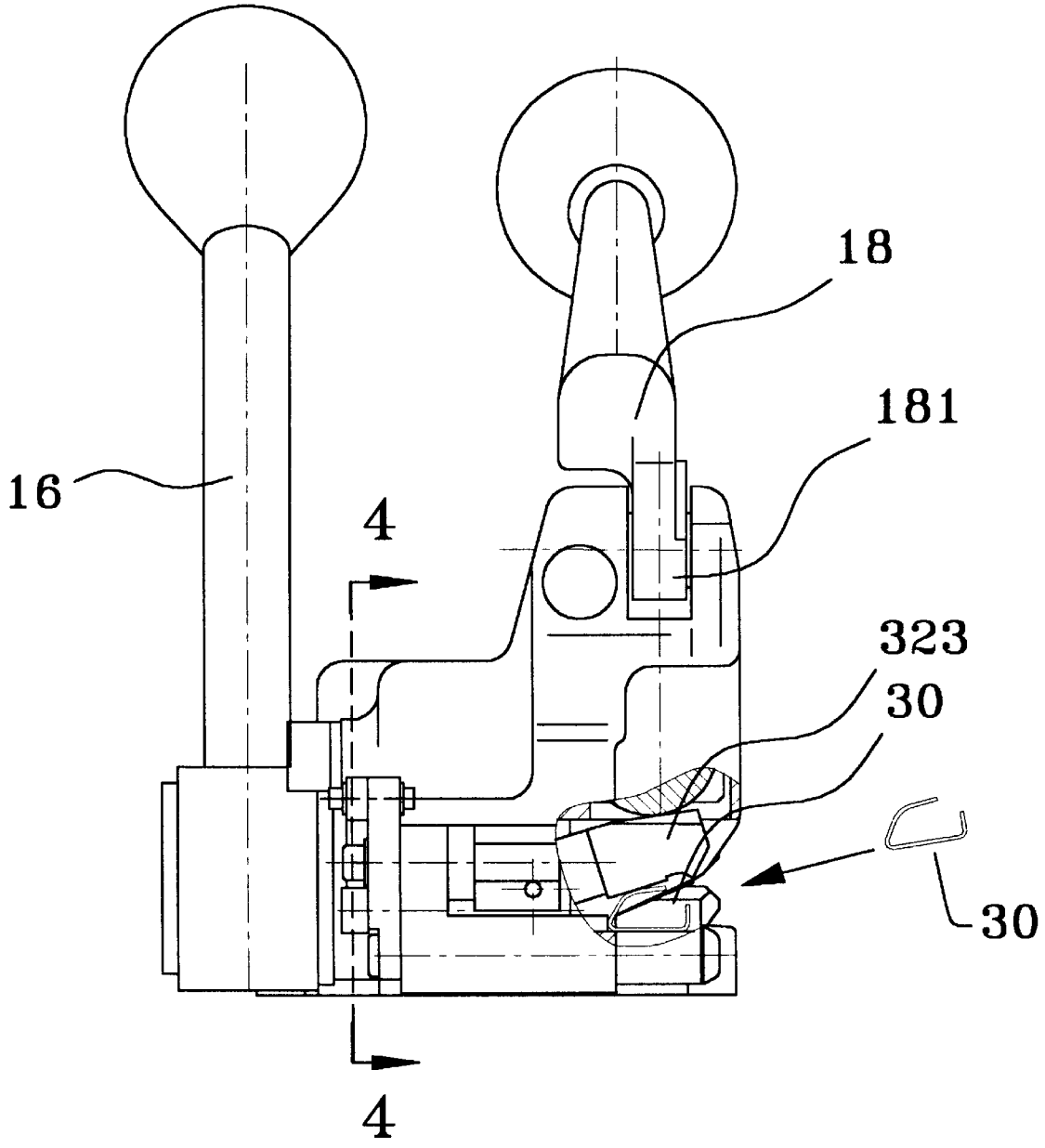
FIG. 2 is a front view in partial cross section of the banding apparatus.
Figure 3:
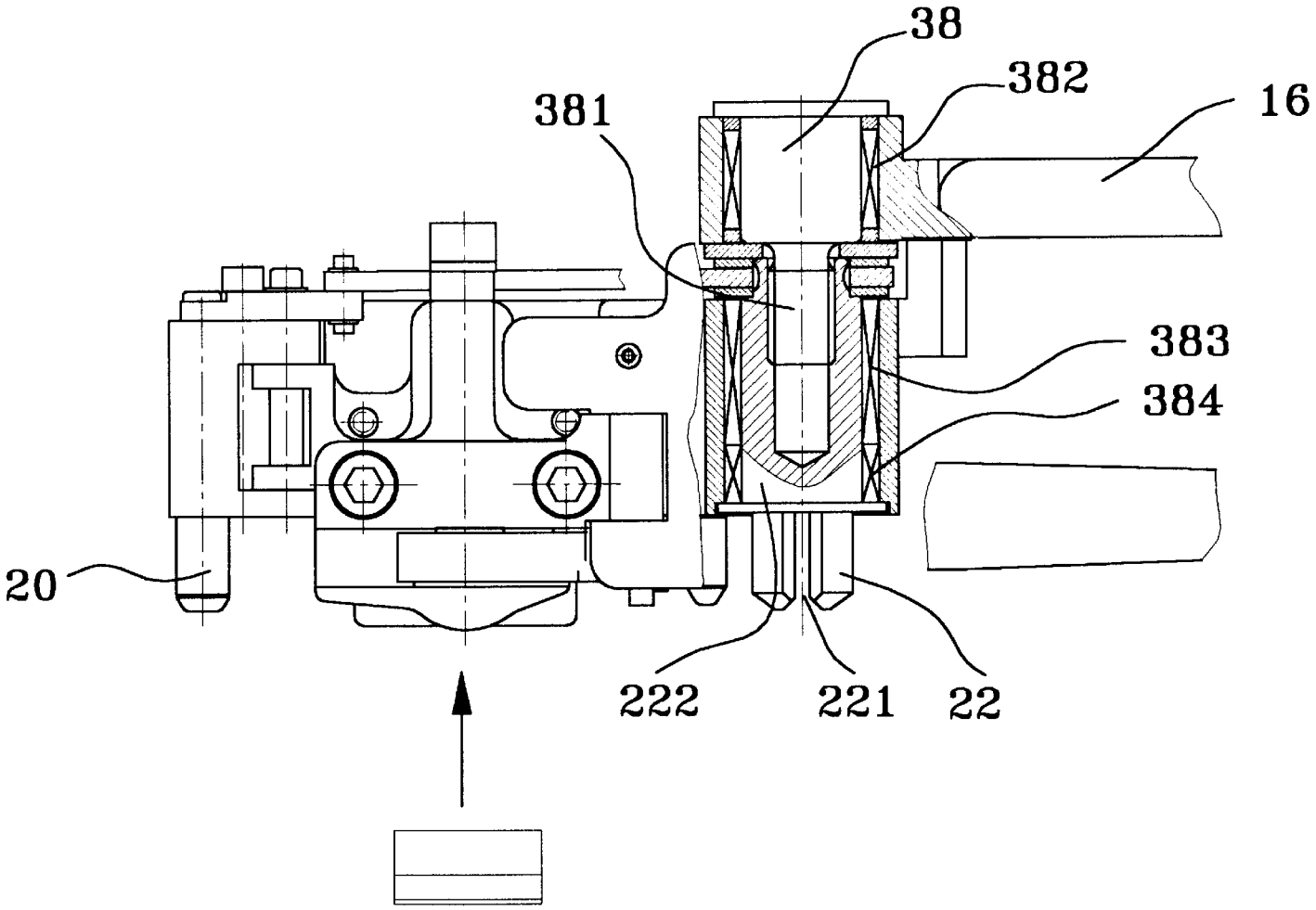
FIG. 3 is a top view in partial cross section of the banding apparatus showing the elements of the tightening mechanism.

Referring first to FIGS. 1–3, the banding apparatus 10 of the present invention includes a main body 12, an actuation lever 14, a tightening lever 16, and a crimping lever 18. The actuation lever 14 controls the operation of three elements: (1) a pivoting front guide bar 20 at a front end of the banding apparatus 10, (2) a cutting device 34 located in front of a windlass 22, and (3) a windlass return mechanism 36 attached to the windlass 22. The tightening lever 16 is used to rotate the windlass 22 so that a band 24 is tightened around the package or articles to be banded. A crimping mechanism 32 is operated by the crimping lever 18. The crimping mechanism 32 closes a seal 30 after the tightening steps of the banding operation.

The structure of the tightening drive mechanism 38 is shown in cross section detail in FIG. 3. The tightening lever 16 causes the drive shaft 381 to rotate when the tightening lever 16 is operated. A tightening lever clutch mechanism 382 allows the tightening drive to be ratchetecl by the tightening lever 16. That is, the clutch 382 secures the tightening lever 16 to the drive shaft 381 when the tightening lever 16 is pushed forward and is applying tension to the band 24. The tightening lever clutch 382 releases when pressure on the tightening lever 16 is released, so that tension on the band 24 is maintained as the tightening lever 16 is pulled back.

A windlass clutch 383 is in communication with a windlass bearing 384. The windlass clutch 383 allows tension to be maintained on the windlass 22 and the band 24 while the tightening lever 16 is being ratcheted.

The windlass 22 includes a central opening 221 comprising orthogonal channels that are coincident with diameters of the windlass 22. The central opening receives the ends of the band 24 during the tightening phase of the banding process. In the loading position, the channel of the central opening 221 that will receive the band 24 is angled upward from front to rear at an angle of approximately 15° to 25°. The angle can be set to any orientation desired by the user to facilitate loading of the band 24. The windlass return mechanism 36 ensures that the windlass 22 is in the desired angled loading position. The operation of the windlass return mechanism is controlled by the actuation lever 14.

The operation of the windlass return mechanism 36 and the actuation lever 14 is illustrated in FIGS. 4A–C. FIG. 4A shows the position of the actuation lever 14 and the return mechanism 36 at the conclusion of a banding operation. The front guide bar 20 is in a lowered position and is under pressure from the band 24. The windlass drive shaft 222 has been rotated to tighten the band 24 around the package. The return cylinder 361 of the return mechanism 36 is therefore not engaged with the windlass drive shaft 222.

FIG. 4B shows the situation after the actuation lever 14 has been raised, but while the device is still engaged with the uncut band 24. The actuation lever 14 compresses an actuation spring 141 and a return spring 363 as the actuation lever 14 is raised. The front guide bar 20 is in communication with the return mechanism 36 through front guide bar arm 201. Since the front guide bar 20 is still under pressure from the band 24, there is no rotation of the return mechanism 36.

When the band 24 is cut, and the device 10 is disengaged from the tightened band 24 on the package, which is the situation shown in FIG. 4C, the pressure on the front guide bar 20 and on the windlass 22 is released. This allows the return spring 363 to expand. As the return spring 363 expands, a return bar 364 is pulled upward. As return bar 364 moves upward, return cylinder 361 is rotated, and the front guide bar arm 201 is pulled rearward to raise the front guide bar 20.

The rotation of the return cylinder 361 under the pulling force of the return spring 363 is in the same direction as the tightening rotation. This causes spring loaded pawl 362 to engage one of the notches 223 so that the drive shaft 222 is rotated to the desired loading position described above. When the operator releases the actuation lever 14, the actuation spring 141 pulls the actuation lever 14 downward to the lowered position shown in FIG. 4A.

The seal 30 or securing clip used to secure the band 24 around the package or articles being banded is shown in FIGS. 5A–C. The seal 30 has an open slot 301 that extends the length of the seal 30 to allow convenient insertion of the band 24. The seal chamber 28 is situated on a side of the machine 10 so that a user can easily insert the seal 30 while he is operating the machine. At the beginning of the banding operation, the seal 30 is placed in the seal chamber 28 with the open slot 301 facing outward in order to receive the band 24. The open slot 301 is later closed during the seal crimping process.

Figure 6B:
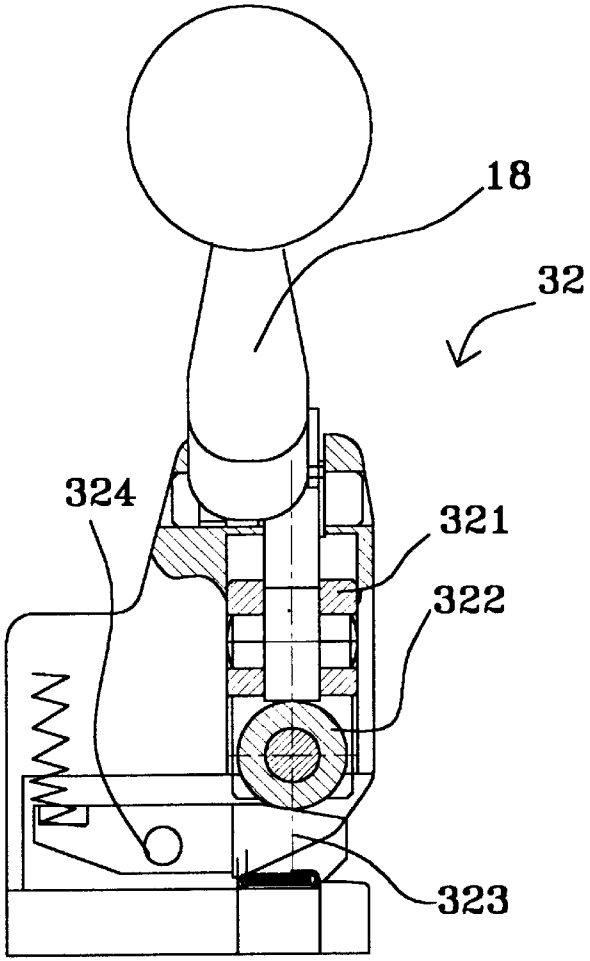
FIGS. 6A–B are cutaway front views of the machine illustrating the crimping mechanism with the crimping lever lowered and pushed forward respectively.
Figure 6A:
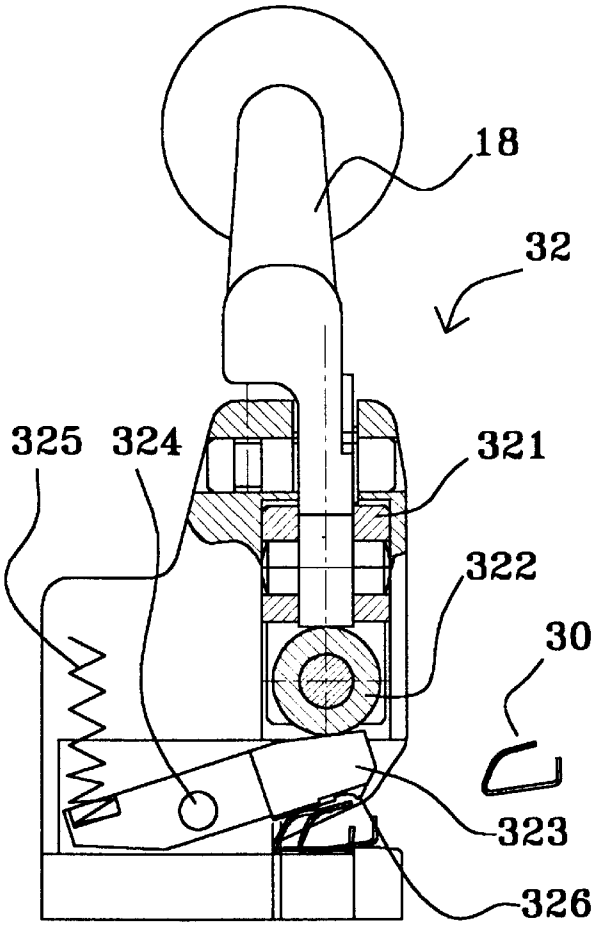
Figure 7A:
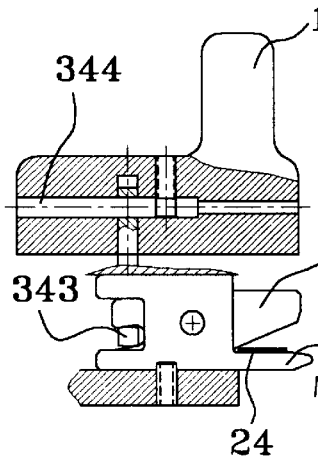
FIG. 7A is a partial cross section showing the cutting device in the open position.
Figure 7B:
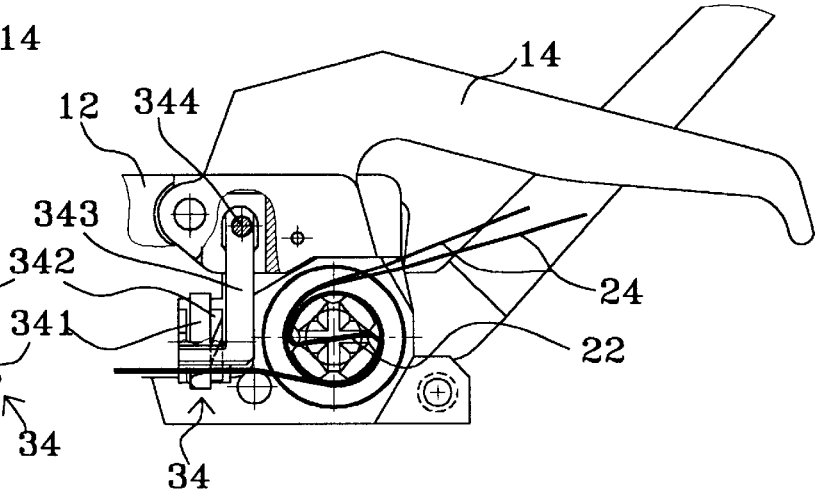
FIG. 7B is a side view of the apparatus with the actuation lever lowered and the cutting device in the open position.
Figure 7C:
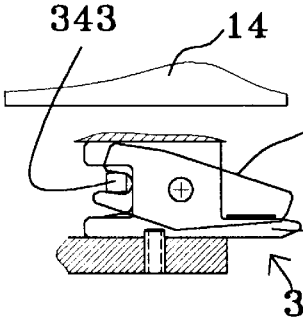
FIG. 7C is a partial cross section showing the cutting device in the closed position.
Figure 7D:
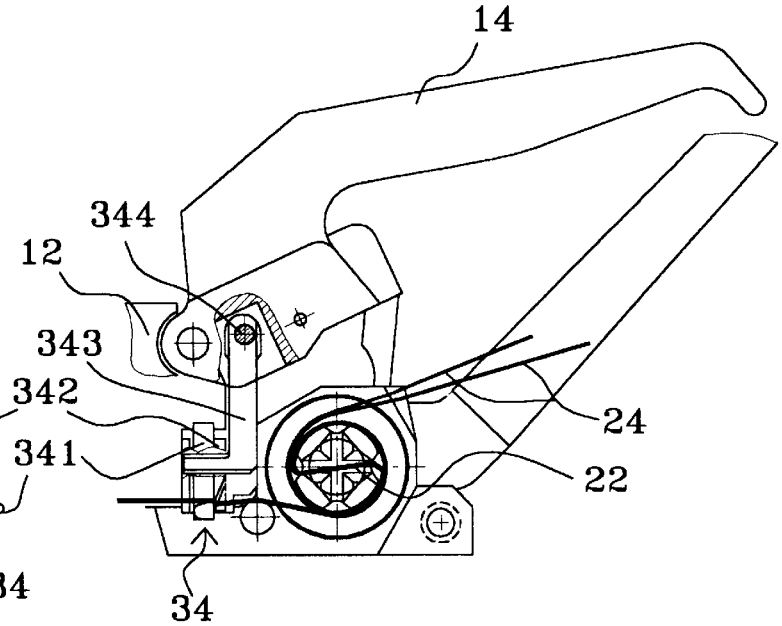
FIG. 7D is a side view of the apparatus with the actuation lever raised so that the cutting device is closed to cut the band.

FIGS. 6A and 6B illustrate the crimping means 32. An upper roller 321 is in contact with an eccentric cam 181 at the end of the crimping lever 18. When the crimping lever 18 is pushed forward, the cam 181 drives the upper roller downward. The upper roller is positioned on a lower roller 322. The lower roller 322 rests on a crimping bar 323 that pivots about a shaft 324. One end of the crimping bar 323 is affixed to a power spring 325 that always maintains the crimping bar 323 in contact with the lower roller 322. A retaining edge 326 on the crimping bar 323 secures the seal 30 in position during the crimping operation.

The cutting device 34 is shown in detail in FIGS. 7A–D. The cutting device 34 includes a stationary lower jaw 341 and a pivoting upper jaw 342. During the banding operation, the two ends of the band 24 are threaded between the upper and lower jaws 341, 342 of the cutter 34. The upper jaw 342 is in communication with the actuation lever 14 through a cutter lever 343 that is attached to the actuating lever 14 by shaft 344. When the actuation lever 14 is raised, the upper jaw 342 moves from the raised position shown in FIG. 7A to the lowered position shown in FIG. 7C. As the cutting jaws 341, 342 cross, the two ends of the band 24 that are threaded through the cutting device 34 are cut. The lower length of the band 24, which is positioned beneath the lower jaw 341, is not affected by the cutting operation.

Figure 8:
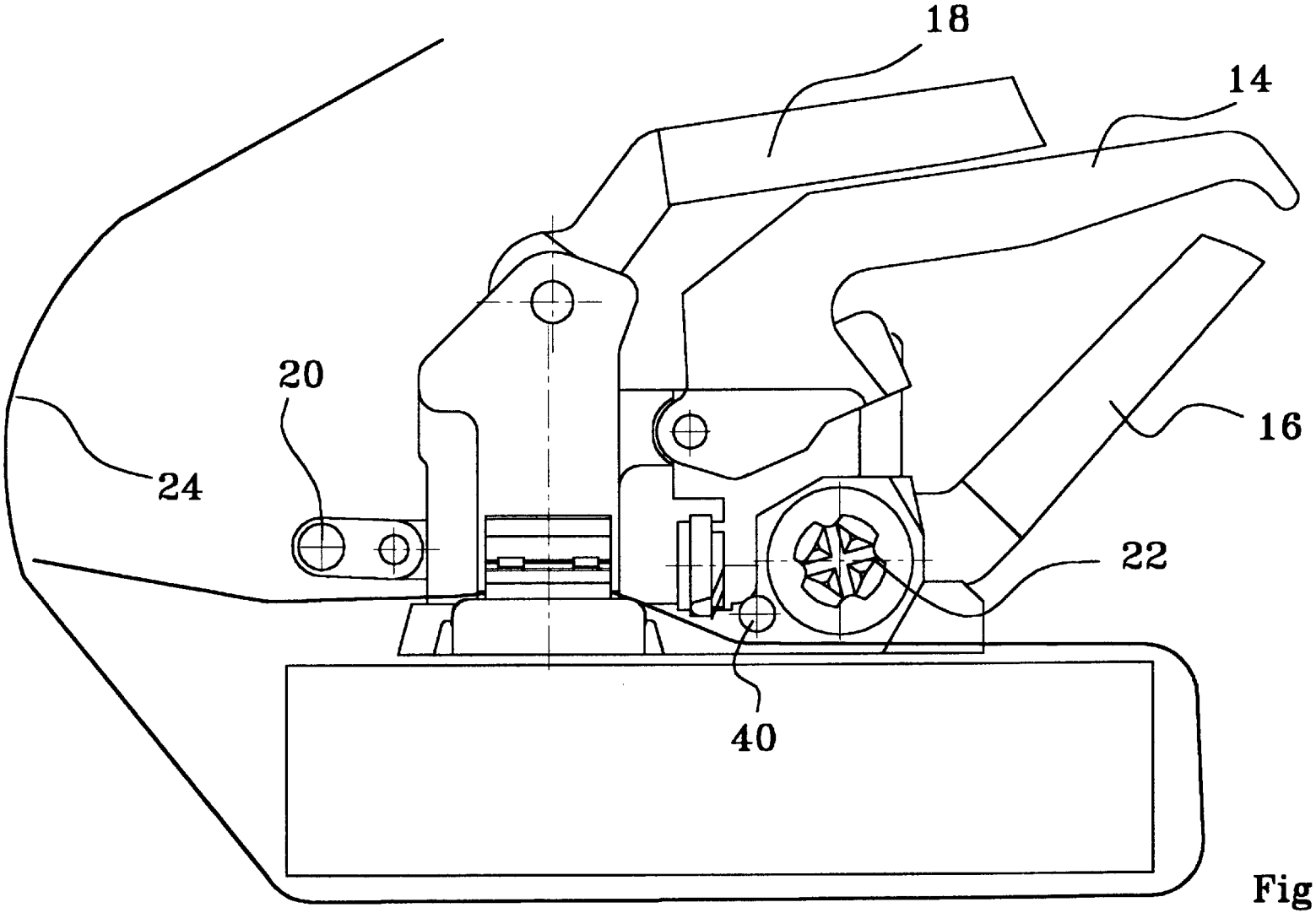
FIG. 8 shows the device with a first end of the band inserted into the device and the band looped around the package to be secured.
Figure 9:
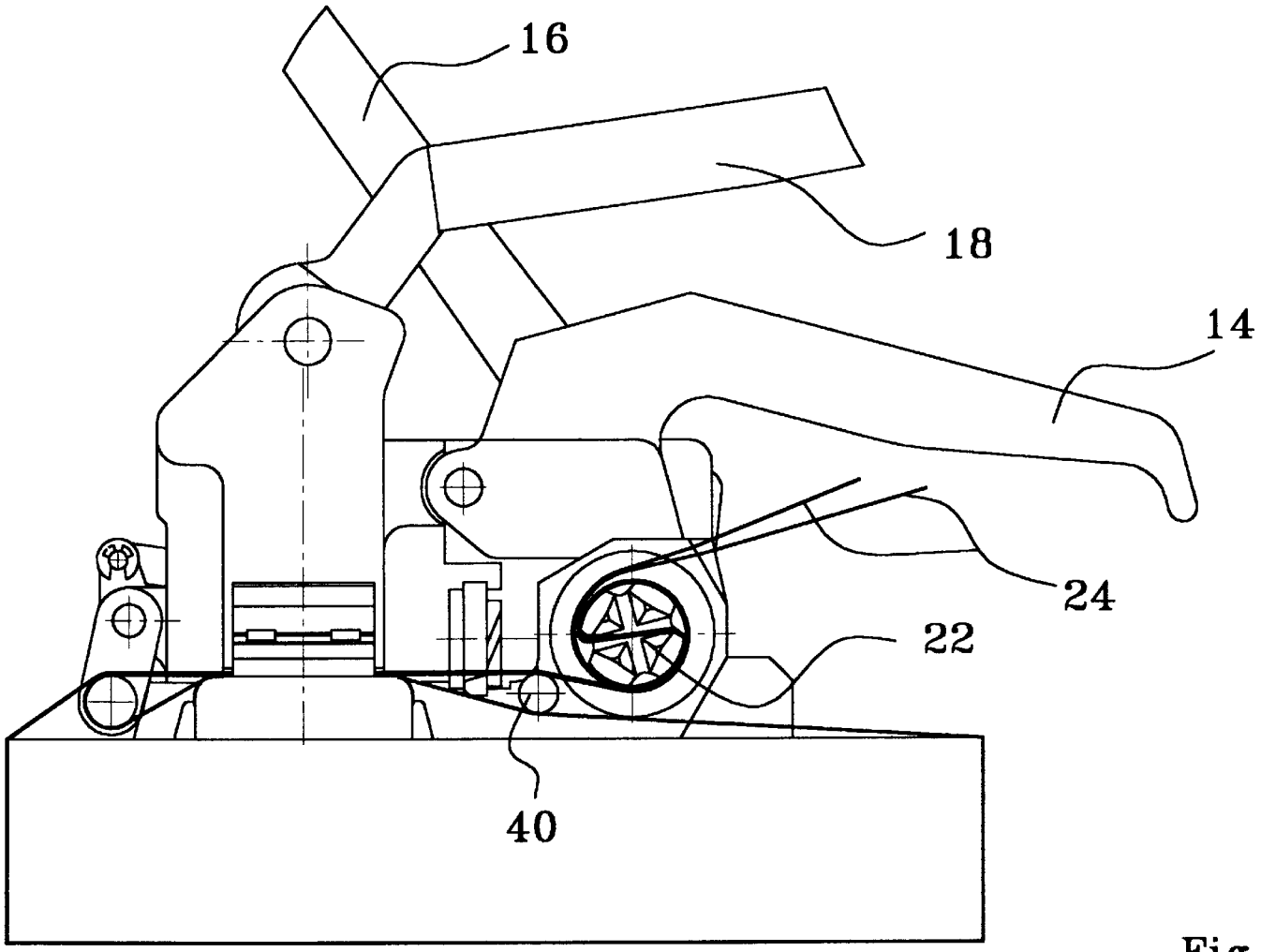
FIG. 9 shows the device with a second end of the band inserted into the device, with both ends passing through the seal and then through the windlass.

Referring now to FIG. 8, with the windlass in the loading position and the actuation lever 14 raised, a first end of the band 24 is inserted into the banding apparatus 10. The first end of the band 24 passes under the windlass 22, a rear divider 40, and the cutting device 34. The first end of the band 24 is then extended from the front of the device sufficiently so that the two ends of the band 24 can be placed together. The lever 14 is released, and actuation spring 141 (shown in FIG. 4) returns the lever 14 to its lowered position. Lowering the lever 14 moves the front guide bar 20 to the lowered position shown in FIG. 9, and presses the first end of the band 24 downward.

The user joins the two ends of the band 24 and reverse threads them through the open slot 301 of the seal 30. (The seal 30 has been loaded into the seal chamber 28.) This results in there being three layers of the band 24 in the seal 30. The two joined ends of the band 24 are passed through the cutting device 34, over the rear divider 40, and through the central opening 221 of the windlass 22. At this point, the band 24 is ready to be tightened around the package or articles being banded.

Figure 10:
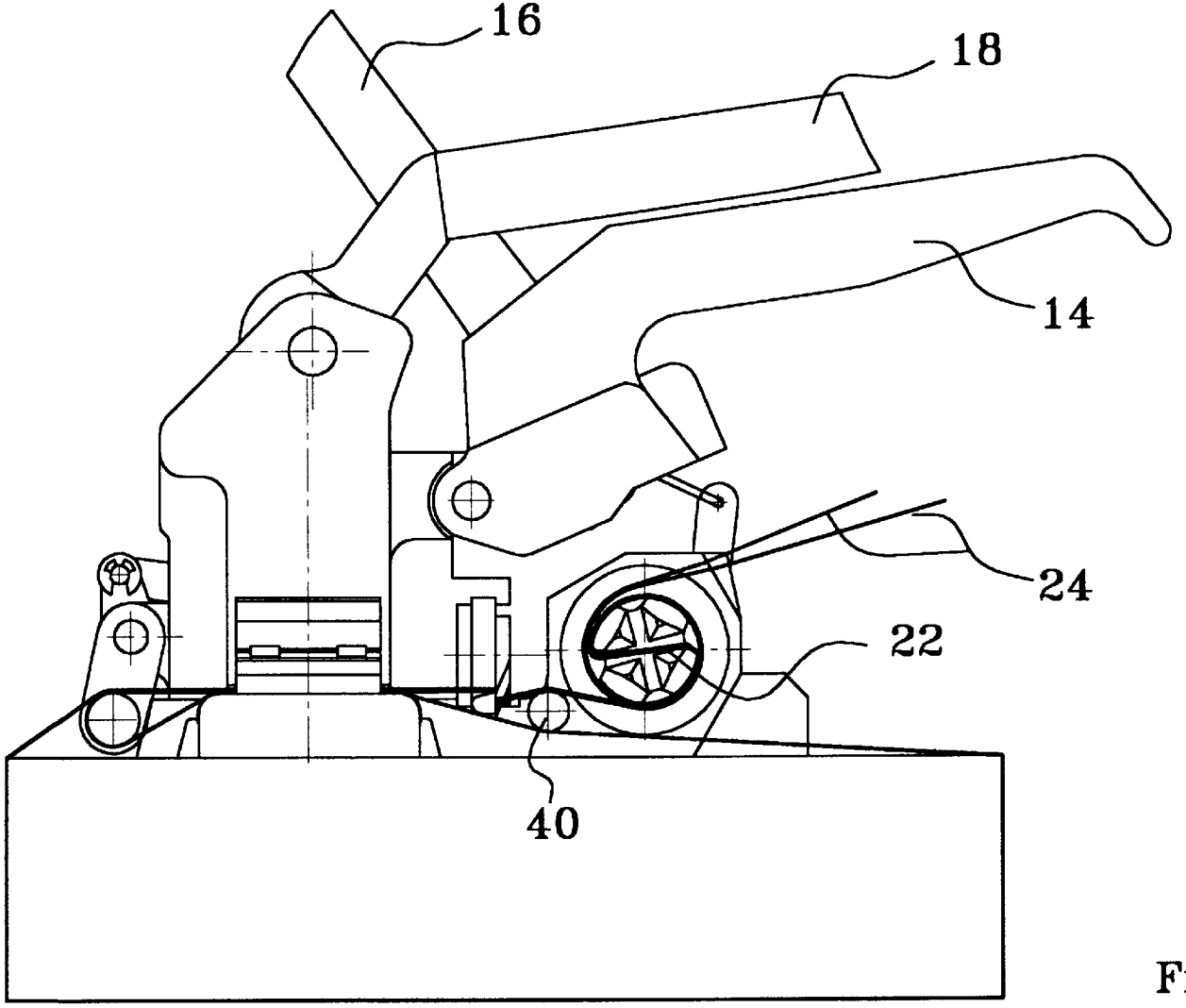
FIG. 10 illustrates a typical packaging situation after the windlass has tightened the band around the package and the band has been cut.

The user then operates the tightening lever 16 to rotate the windlass 22 until the band 24 is drawn to the tension desired to securely bind the package or articles as shown in FIG. 10. There is no net pulling force on the device 10 during the tightening operation due to the fact that both ends of the band 24 are pulled simultaneously by the windlass 22. This results in there being no net resultant forward force on the banding machine, which eliminates any forward motion of the device 10 during the banding operation, and equalizes the tension of the band around the package.

After the band 24 is tightened around the package, the seal crimping means 32 is actuated by pushing forward the crimping lever 18. When the crimping lever 18 is pushed forward, the cam 181 at the end of the crimping lever 18 drives the rollers 321, 322 downward onto the crimping bar 323. This causes the crimping means 32 to crush the seal 30 around the band 24 to secure the band 24 in the tightened position.

At the end of the banding operation, the operator once again raises the actuation lever 14. This causes the cutting device 34 to cut the band 24. When the device is disengaged from the band 24, the return mechanism 36 returns the windlass 22 to its optimal loading position.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

We claim:

1. A banding apparatus comprising:

a main body upon which are mounted;

a tightening means, said tightening means includes a windlass that receives both ends of a band, said windlass is rotated by the tightening means to tighten the band around a package by said windlass applying a pulling force to both ends of the band simultaneously, a windlass return mechanism that after a securing operation returns said windlass to an optimal position for loading a band for a next operation cycle, a guide bar means to serve as a base, said tightening means pulls the band against said guide bar means, a crimping means that at the end of each said securing operation affixes the band in a tightened position with a seal, and a cutting means to cut the ends of the band near said seal at the end of each said securing operation.

2. The banding apparatus of claim 1 wherein:

said windlass return mechanism comprises a return cylinder that engages a windlass drive shaft when said return mechanism is actuated by an actuation means, said actuation means includes an actuation lever that compresses a first spring and a second spring as said actuation lever is raised, a front guide bar that is in communication with said return mechanism through a front guide bar arm such that when said front guide bar is under pressure from a tightened band, there is no rotation of said cylinder of said return mechanism, and when the band is cut and the device is disengaged from the tightened band on the package, the pressure on the front guide bar and on the windlass is released, thereby allowing said second spring to expand, pulling a return bar of said return mechanism upward, said return bar is pivotally attached to said return cylinder such that when said return bar moves upward, said return cylinder is rotated and said front guide bar arm is pulled rearward to raise said front guide bar, rotation of said return cylinder under the pulling force of said second spring is in the same direction as the tightening rotation which causes a spring loaded pawl to engage one of a plurality of notches in said windlass drive shaft so that said windlass is rotated to an optimal loading position, and when an operator releases said actuation lever, said first spring pulls said actuation lever downward to a starting position.

3. The banding apparatus of claim 1 wherein:

the apparatus further includes an actuation means;

said actuation means operates a pivoting front guide bar at a front end of the banding apparatus, said front guide bar is in communication with a cylinder of said windlass return mechanism by means of a guide bar arm, said guide bar pushes said band downward to facilitate loading of the band into the banding apparatus when an actuation lever of said actuation means is activated; and said actuation means further operates said cutting means by moving a pivoting upper jaw of said cutting means that is in communication with said actuation lever such that when said actuation lever is raised, said upper jaw is moved past a stationary lower jaw of said cutting means so as to cut the two ends of the band which are threaded through said cutting means when the band is loaded into the banding apparatus, a lower portion of the band being loaded under said lower jaw so as not to be affected by said cutting means.

4. The banding apparatus of claim 1 wherein:

said crimping means comprises an eccentric cam positioned at the end of a crimping lever, an upper roller positioned above and in contact with a lower roller, said lower roller is in contact with a crimping bar, said crimping bar pivots about a shaft, said crimping bar is affixed to a power spring that maintains said crimping bar in contact with said lower roller; such that when said crimping means, is activated, said cam drives said upper roller, said lower roller, and said contact end of said crimping bar downward so that said seal is tightened around the band, there being at least three layers of said band in said seal.

5. The banding apparatus of claim 1 wherein:

a tightening drive mechanism causes a drive shaft to rotate when a tightening lever is operated, a tightening lever clutch mechanism allows said tightening drive mechanism to be ratcheted by said tightening lever by means of a first clutch that secures said tightening lever to said drive shaft when said tightening lever is pushed forward, said first clutch releases when pressure on said tightening lever is released to maintain tension of the band as said tightening lever is pulled back, and a second clutch allows tension to be maintained on said windlass and the band while said tightening lever is being ratcheted.

6. A method of securing a band around a package comprising the following steps:

(a) threading a first end of the band through a banding apparatus and a seal inserted therein, (b) extending the first end of the band from a front of the device so that the first end can be placed together with a second end of the band and reverse threaded through the device, (c) reverse threading the first end of the band around a guide bar means and joining the two ends of the band and reverse threading them through the device and through a seal loaded into a seal chamber of the device, (d) passing the two ends of the band through a cutting means and into a windlass of the device, (e) rotating the windlass so as to simultaneously pull both ends of the band until the band is drawn to a tension required to securely bind the package, and (f) securing the band in place with a securing means.

7. The method of claim 6 wherein:

said securing band contains at least three layers of said band therein.

8. The method of claim 6 wherein:

said securing means is a seal affixed by a seal crimping means actuated by raising a crimping lever, when said crimping lever is raised, an eccentric cam at an end of said crimping lever drives a crimping bar downward so as to crush said seal around the band to secure the band in the tightened position.

9. The method of claim 6 wherein:

following each securing operation, the windlass is returned to an optimal loading position by a windlass return mechanism.

10. The method of claim 6 wherein:

following each securing operation, the two ends of the band threaded through said windlass are cut by the cutting means, a movable upper jaw of the cutting means passing over a stationary lower jaw of the cutting means.

11. A method of securing a band around a package comprising the following steps:

(a) with a windlass of a banding apparatus in a loading position and an actuation lever of the banding apparatus raised, threading a first end of the band under the windlass, under a rear divider, under the cutting means, and through a seal loaded into a seal chamber of the banding apparatus, (b) the first end of the band is then extended from a front of the device sufficiently so that the first end and a second end of the band can be placed together with sufficient length to reverse thread said band through the device, (c) releasing the actuation lever so that a spring returns the lever to a lowered position, said releasing of the actuation lever also lowers a front guide bar to a lowered position so as to press the first end of the band downward, (d) joining the two ends of the band and reverse threading the two ends through the seal, through the cutting means, over the rear divider, and through a central opening of the windlass, (e) operating a tightening lever to rotate the windlass until the band is drawn to a tension desired to securely bind the package, (f) actuating a seal crimping means by raising a crimping lever to cause an eccentric cam located at an end of the crimping lever to drive a crimping bar downward so as to crush the seal around the band to secure the band in a tightened position, (g) raising the actuation lever to actuate the cutting means to cut the band, and (h) disengaging the device from the band so that a return mechanism returns the windlass to the optimal loading position.

* * * * *